US007556051B2

(12) United States Patent
Lai

(10) Patent No.: US 7,556,051 B2
(45) Date of Patent: Jul. 7, 2009

(54) SUSPENSION UMBRELLA OPERATED EASILY AND QUICKLY

(76) Inventor: Jin-Sheng Lai, 58, Ma Yuan West St., Taichung (TW)

( * ) Notice: Subject to any disclaimer, the term of this patent is extended or adjusted under 35 U.S.C. 154(b) by 145 days.

(21) Appl. No.: 11/717,915

(22) Filed: Mar. 15, 2007

(65) Prior Publication Data

US 2008/0223422 A1 Sep. 18, 2008

(51) Int. Cl.
*A45B 17/00* (2006.01)
*A45B 11/00* (2006.01)

(52) U.S. Cl. ..... 135/21; 135/20.3; 135/98

(58) Field of Classification Search ..... 135/20.3, 135/20.1, 21, 90, 98; 473/482–484
See application file for complete search history.

(56) References Cited

U.S. PATENT DOCUMENTS

| | | | | |
|---|---|---|---|---|
| 4,606,366 | A * | 8/1986 | Collet | 135/20.1 |
| 5,116,258 | A * | 5/1992 | Vennik | 135/20.3 |
| 5,678,585 | A * | 10/1997 | May | 135/20.1 |
| 5,735,302 | A * | 4/1998 | Saliva | 135/20.1 |
| 5,937,882 | A * | 8/1999 | Harbaugh | 135/20.3 |
| 6,014,980 | A * | 1/2000 | Glatz | 135/20.1 |
| 6,152,156 | A * | 11/2000 | Tung | 135/21 |
| 6,220,261 | B1 * | 4/2001 | Glatz | 135/20.3 |
| 6,435,444 | B1 * | 8/2002 | Lin | 242/396.6 |
| 6,478,037 | B2 * | 11/2002 | Tung | 135/21 |
| 6,619,306 | B2 * | 9/2003 | Ma | 135/21 |
| 6,662,815 | B2 * | 12/2003 | Tung | 135/20.1 |
| 7,134,442 | B2 * | 11/2006 | Ma | 135/20.1 |
| 2006/0278262 | A1 * | 12/2006 | Ma | 135/98 |

FOREIGN PATENT DOCUMENTS

EP 1042973 A1 * 10/2000

* cited by examiner

*Primary Examiner*—Winnie Yip
(74) *Attorney, Agent, or Firm*—Alan Kamrath; Kamrath & Associates PA

(57) ABSTRACT

A suspension umbrella includes an upright support post, a sliding seat, a control shaft, an umbrella frame, and a drive cord. The umbrella frame includes a shank, a plurality of ribs, a plurality of spreaders and a runner. Thus, the umbrella frame is expanded when the control shaft is movable toward the umbrella frame and is folded when the control shaft is movable outwardly relative to the umbrella frame, so that the umbrella frame is expanded and folded easily and conveniently. In addition, the user only needs to operate the control handle to move the control shaft so as to expand or fold the umbrella frame easily and quickly, thereby greatly facilitating the user operating the suspension umbrella.

11 Claims, 8 Drawing Sheets

SUSPENSION UMBRELLA OPERATED EASILY AND QUICKLY

BACKGROUND OF THE INVENTION

1. Field of the Invention

The present invention relates to an umbrella and, more particularly, to a suspension umbrella.

2. Description of the Related Art

A conventional suspension umbrella has a bottom mounted on a center of a table. Thus, the suspension umbrella is expanded to shade the table so that the table is used outdoors in the sunshine. However, the suspension umbrella is located above the table, so that the suspension umbrella is very close to the table, thereby easily causing an uncomfortable sensation to the user. In addition, the suspension umbrella is fixed on the table, so that the suspension umbrella cannot be folded independently when not in use.

BRIEF SUMMARY OF THE INVENTION

In accordance with the present invention, there is provided a suspension umbrella, comprising an upright support post, a sliding seat mounted on an upper end of the support post, a control shaft movably mounted on the sliding seat, an umbrella frame mounted on a first end of the control shaft to move with the control shaft and including a shank, a plurality of ribs each pivotally mounted on an upper end of the shank, a plurality of spreaders each having a first end pivotally connected with a respective rib and a runner pivotally connected with a second end of each of the spreaders and movable relative to the shank, and a drive cord having a first end secured on the sliding seat and a second end extended through the shank of the umbrella frame and secured to the runner of the umbrella frame to move the runner of the umbrella frame relative to the shank of the umbrella frame and to move the spreaders of the umbrella frame relative to the ribs of the umbrella frame.

The primary objective of the present invention is to provide a suspension umbrella that is operated easily and quickly.

Another objective of the present invention is to provide a suspension umbrella, wherein the umbrella frame is expanded when the control shaft is movable toward the umbrella frame and is folded when the control shaft is movable outwardly relative to the umbrella frame, so that the umbrella frame is expanded and folded easily and conveniently.

A further objective of the present invention is to provide a suspension umbrella, wherein the user only needs to operate the control handle to move the control shaft so as to expand or fold the umbrella frame easily and quickly, thereby greatly facilitating the user operating the suspension umbrella.

Further benefits and advantages of the present invention will become apparent after a careful reading of the detailed description with appropriate reference to the accompanying drawings.

BRIEF DESCRIPTION OF THE SEVERAL VIEWS OF THE DRAWING(S)

DETAILED DESCRIPTION OF THE INVENTION

Figure 1:
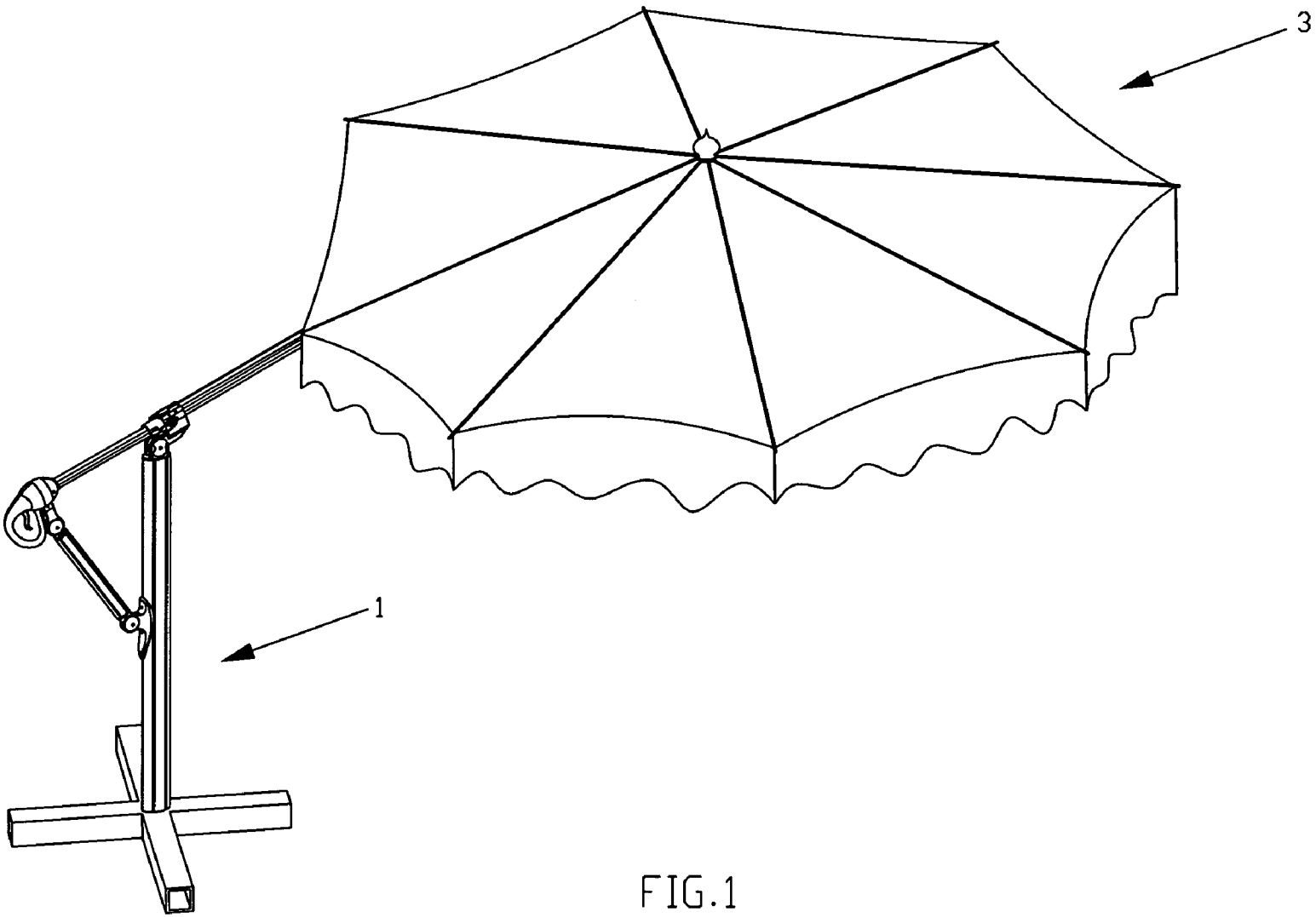
FIG. 1 is a perspective view of a suspension umbrella in accordance with the preferred embodiment of the present invention.

Referring to the drawings and initially to FIGS. 1-6, a suspension umbrella in accordance with the preferred embodiment of the present invention comprises an upright support post 1, a sliding seat 25 mounted on an upper end of the support post 1, a stand 11 mounted on a lower end of the support post 1, a control shaft 2 movably mounted on the sliding seat 25, an umbrella frame 3 mounted on a first end of the control shaft 2 to move with the control shaft 2 and including a shank 34, a plurality of ribs 30 each pivotally mounted on an upper end of the shank 34, a plurality of spreaders 301 each having a first end pivotally connected with a respective rib 30 and a runner 35 pivotally connected with a second end of each of the spreaders 301 and movable relative to the shank 34, a drive cord 4 having a first end secured on the sliding seat 25 and a second end extended through the shank 34 of the umbrella frame 3 and secured to the runner 35 of the umbrella frame 3 to move the runner 35 of the umbrella frame 3 relative to the shank 34 of the umbrella frame 3 and to move the spreaders 301 of the umbrella frame 3 relative to the ribs 30 of the umbrella frame 3, a control handle 16 mounted on a second end of the control shaft 2 to move the control shaft 2 and to facilitate a user's hand holding the control handle 16, and an elbow 15 having a first end pivotally connected with the support post 1 and a second end pivotally connected with the control handle 16.

Figure 6:
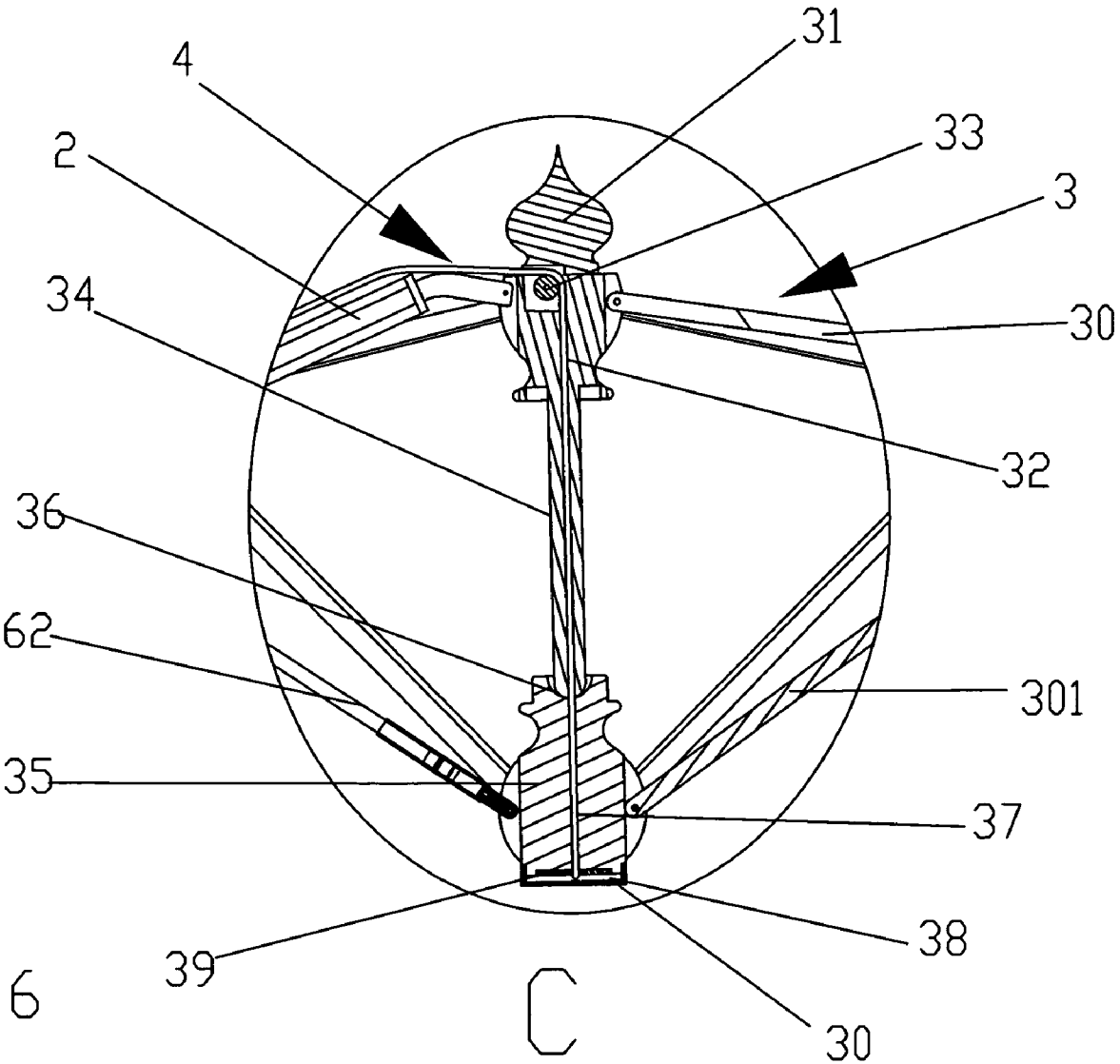
FIG. 6 is a locally enlarged view of the suspension umbrella taken along circle "C" as shown in FIG. 3.

The shank 34 of the umbrella frame 3 is a hollow body and has an inside formed with a passage 32 to allow passage of the drive cord 4. The upper end of the shank 34 of the umbrella frame 3 is formed with an enlarged head 31 pivotally connected with the ribs 30, and the umbrella frame 3 further includes a guide roller 33 rotatably mounted in the enlarged head 31 of the shank 34 and connected to the passage 32 to guide movement of the drive cord 4. The enlarged head 31 of the shank 34 of the umbrella frame 3 is pivotally mounted on the first end of the control shaft 2, and the umbrella frame 3 further includes a fixing seat 61 secured on the control shaft 2 and located between the sliding seat 25 and the umbrella frame 3, and a pivot lever 62 having a first end pivotally connected with the fixing seat 61 and a second end pivotally connected with the runner 35 of the umbrella frame 3. The runner 35 of the umbrella frame 3 has a substantially cylindrical shape and has an inside formed with a channel 37 to allow passage of the drive cord 4. The runner 35 of the umbrella frame 3 has an upper end formed with a positioning recess 36 connected to the channel 37 to receive a lower end of the shank 34 when the runner 35 of the umbrella frame 3 abuts the lower end of the shank 34 as shown in FIG. 6. The umbrella frame 3 further includes a fixing plate 39 mounted on a lower end of the runner 35 and secured to the second end of the drive cord 4, and a bottom cap 30 mounted on the lower end of the runner 35 to cover the fixing plate 39. The lower end of the runner 35 is formed with a stepped receiving recess 38 connected to the channel 37 to receive the fixing plate 39.

The drive cord 4 is parallel with the control shaft 2 and is stretched between the sliding seat 25 and the runner 35 of the umbrella frame 3. The support post 1 has a hollow inside. The sliding seat 25 is located between the umbrella frame 3 and the control handle 16. The sliding seat 25 has a top formed with a fixing hole 26 to fix the first end of the drive cord 4. The suspension umbrella further comprises a limit ring 17 secured on the control shaft 2 to move with the control shaft 2 and movable to rest on the sliding seat 25, a cable 45 having a first end secured on the limit ring 17 to move with the limit ring 17 and a second end extended into the support post 1 and secured to a wall of the support post 1, a weight 5 movably mounted in the support post 1 and attached to the cable 45 to move with the cable 45 and to facilitate push of the control shaft 2 toward the umbrella frame 3, and a guide roller 27 rotatably mounted on the sliding seat 25 and rested on the cable 45 to guide movement of the cable 45.

Figure 2:
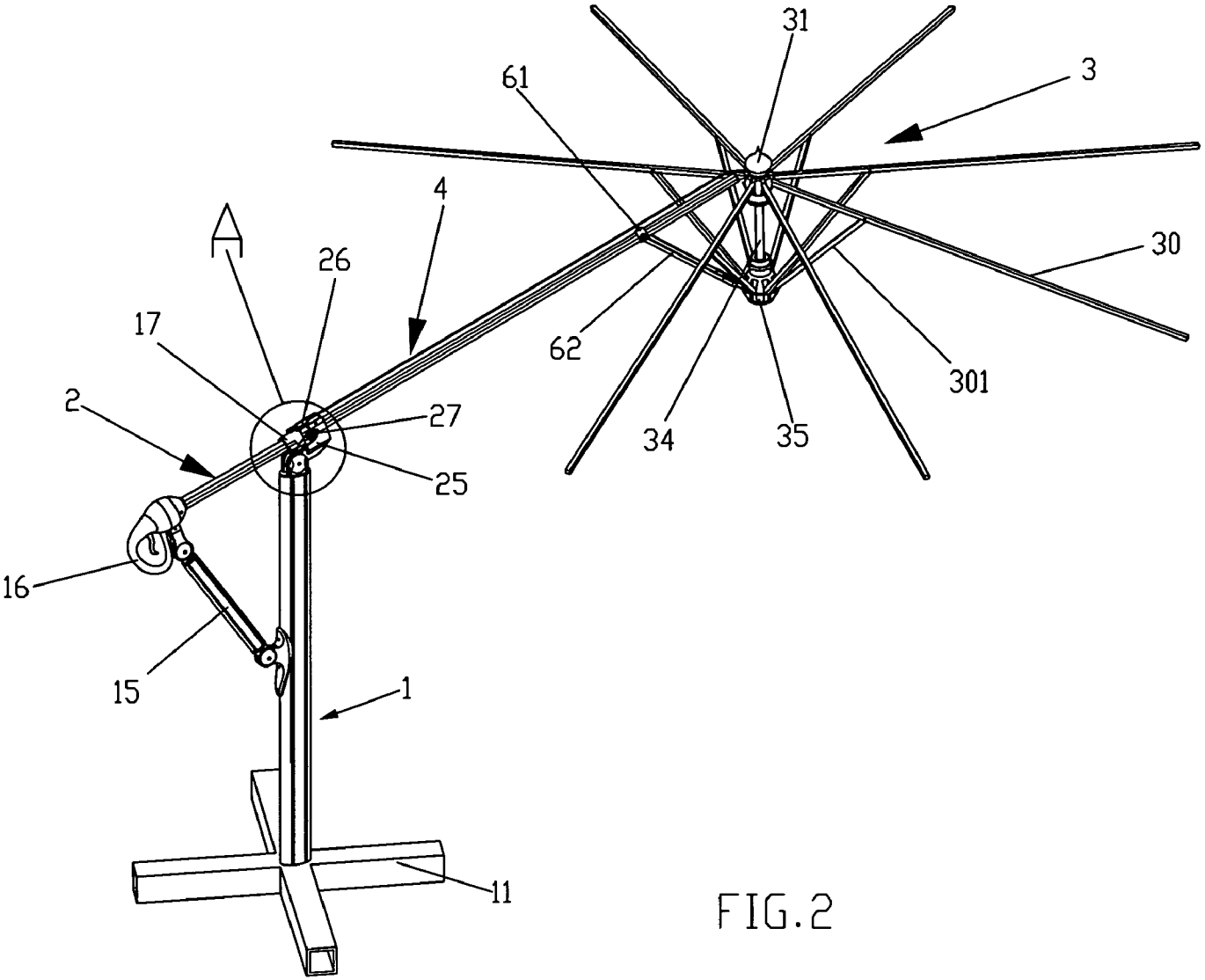
FIG. 2 is a partially perspective view of the suspension umbrella as shown in FIG. 1.
Figure 7:
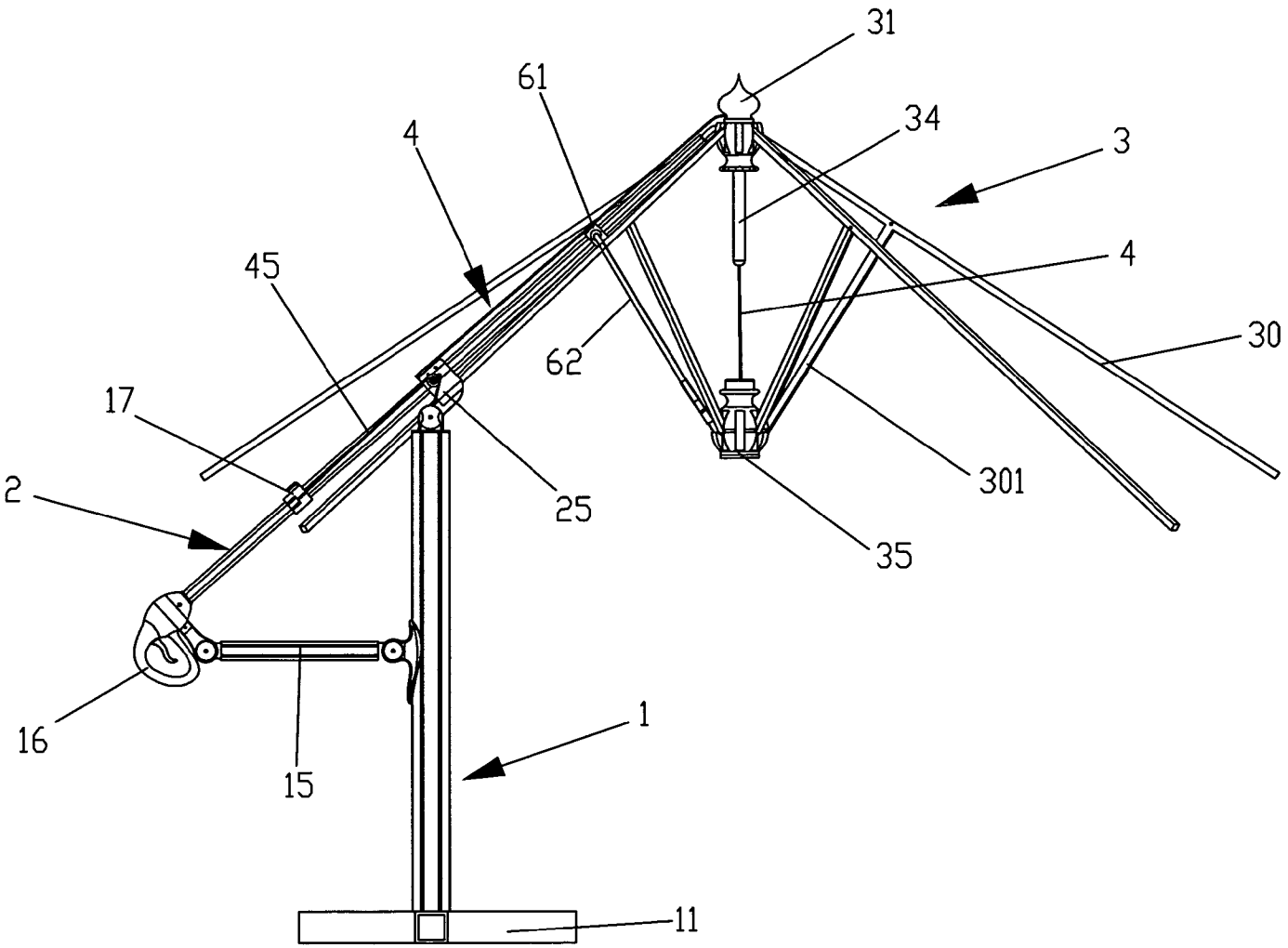
FIG. 7 is a schematic operational view of the suspension umbrella as shown in FIG. 3.
Figure 8:
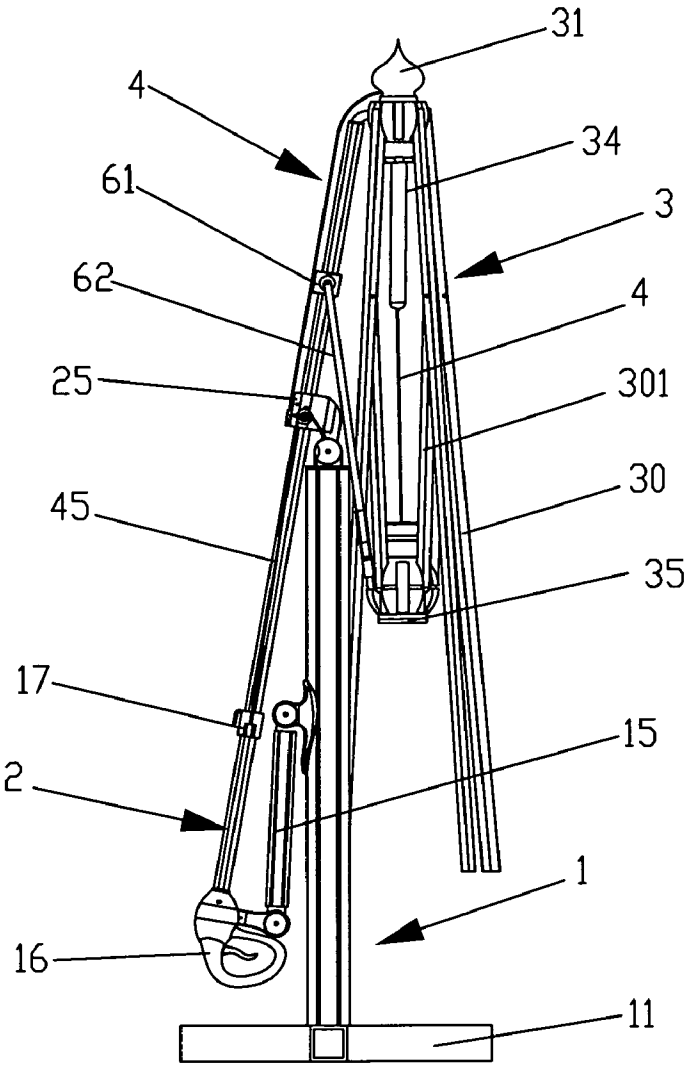
FIG. 8 is a schematic operational view of the suspension umbrella as shown in FIG. 7.

In operation, referring to FIGS. 1-8, when the control shaft 2 is movable outwardly relative to the umbrella frame 3, the umbrella frame 3 is movable toward the sliding seat 25 from the position as shown in FIG. 2 to the position as shown in FIG. 7 to reduce a distance between the umbrella frame 3 and the sliding seat 25, so that the drive cord 4 stretched between the sliding seat 25 and the runner 35 of the umbrella frame 3 is loosened, and the runner 35 of the umbrella frame 3 is released from the drive cord 4 and movable outwardly relative to the shank 34 of the umbrella frame 3 to pivot the spreaders 301 and the ribs 30 of the umbrella frame 3 inwardly relative to the shank 34 and the runner 35 of the umbrella frame 3 so as to fold the umbrella frame 3 as shown in FIG. 8.

Figure 3:
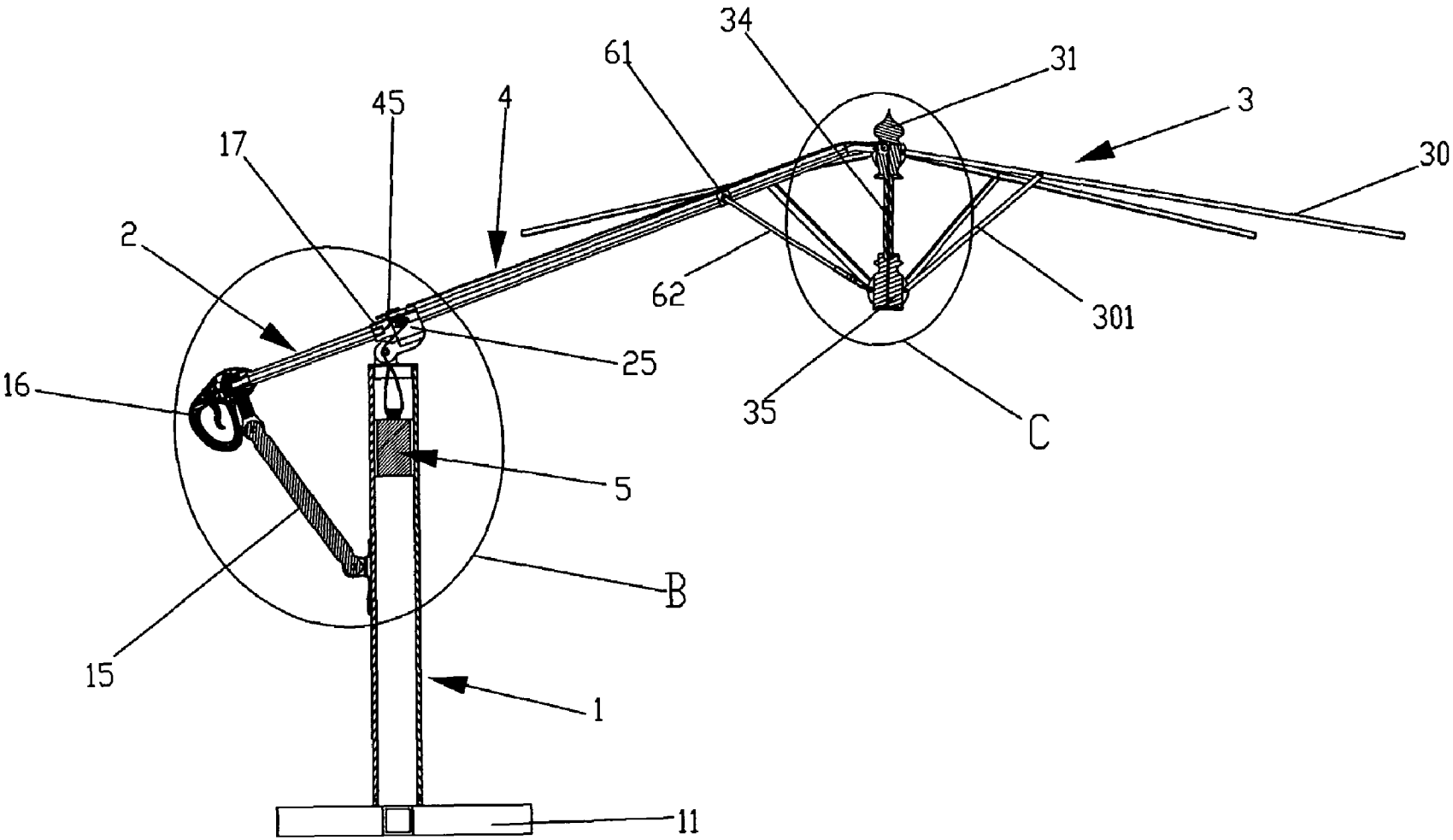
FIG. 3 is a side cross-sectional view of the suspension umbrella as shown in FIG. 1.
Figure 4:
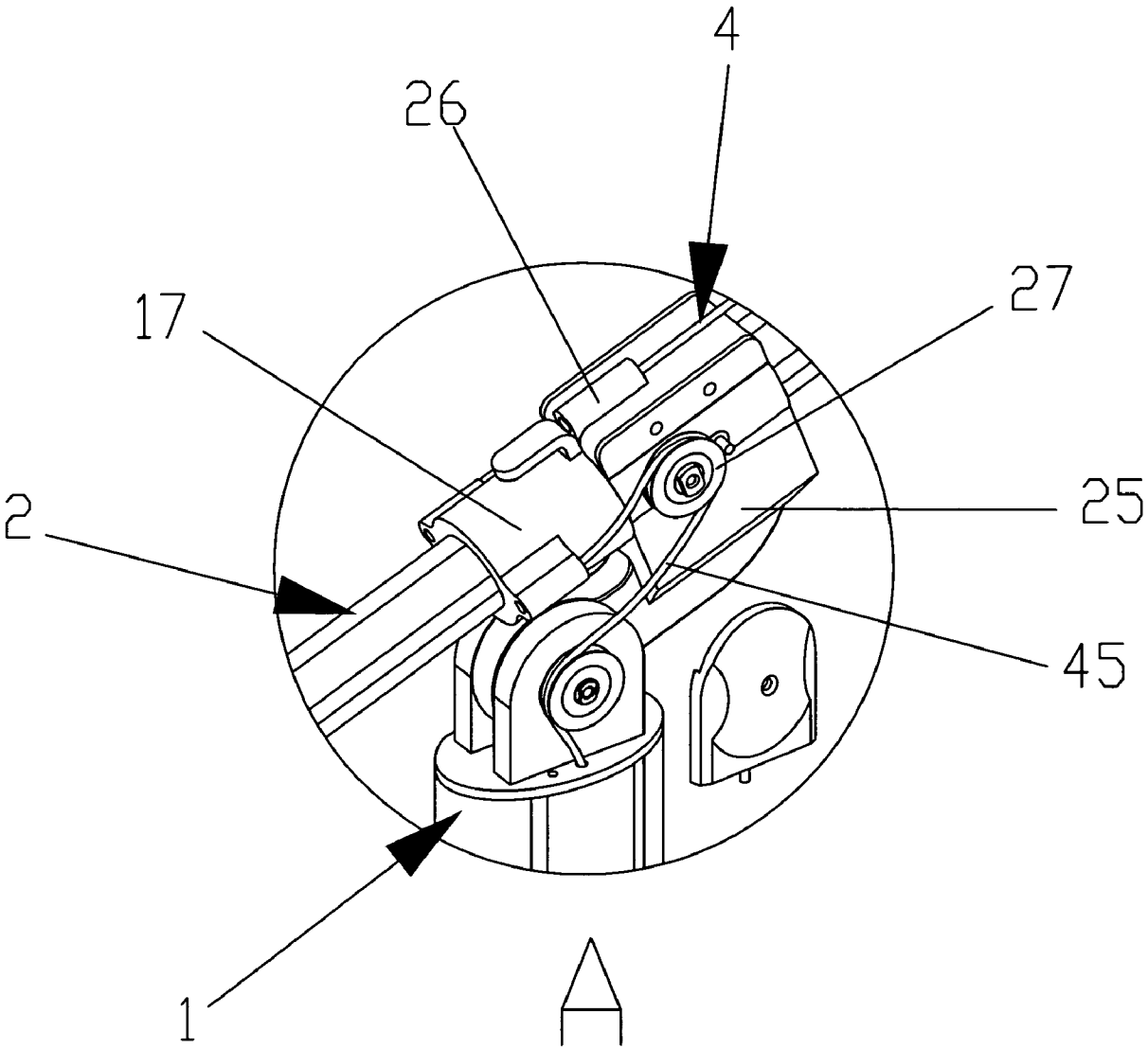
FIG. 4 is a locally enlarged view of the suspension umbrella taken along circle "A" as shown in FIG. 2.
Figure 5:
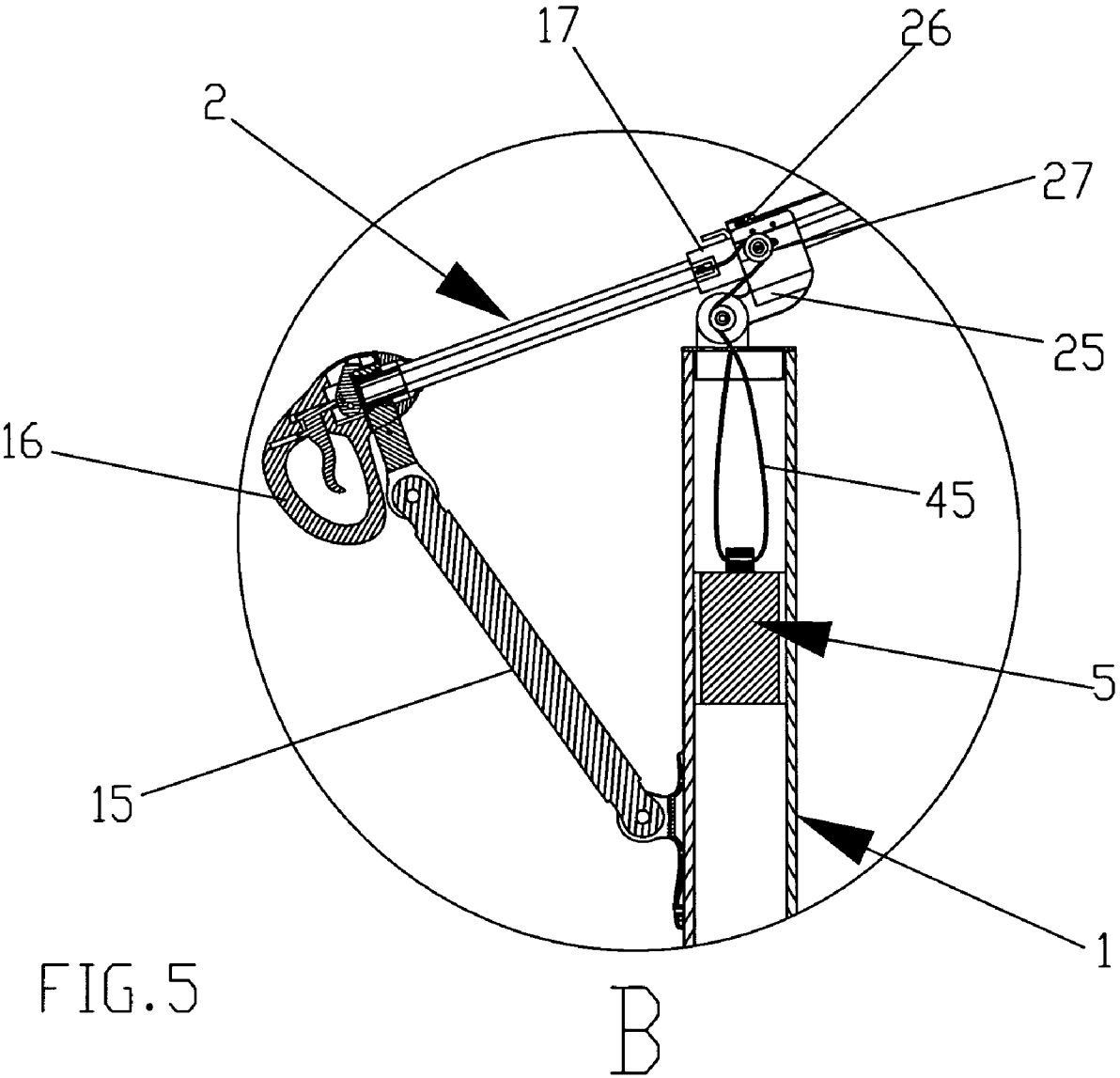
FIG. 5 is a locally enlarged view of the suspension umbrella taken along circle "B" as shown in FIG. 3.

On the contrary, when the control shaft 2 is movable toward the umbrella frame 3, the umbrella frame 3 is movable outwardly relative to the sliding seat 25 from the position as shown in FIGS. 7 and 8 to the position as shown in FIG. 2 to increase a distance between the umbrella frame 3 and the sliding seat 25, so that the drive cord 4 loosened between the sliding seat 25 and the runner 35 of the umbrella frame 3 is stretched, and the runner 35 of the umbrella frame 3 is pulled by the drive cord 4 to move toward the shank 34 of the umbrella frame 3 to pivot the spreaders 301 and the ribs 30 of the umbrella frame 3 outwardly relative to the shank 34 and the runner 35 of the umbrella frame 3 so as to expand the umbrella frame 3 as shown in FIGS. 1-3.

At this time, the limit ring 17 is movable to rest on the sliding seat 25 when the control shaft 2 is movable toward the umbrella frame 3 to limit further movement of the control shaft 2, thereby preventing the control shaft 2 from being moved excessively. In addition, the runner 35 of the umbrella frame 3 abuts the lower end of the shank 34 and the lower end of the shank 34 is positioned in the positioning recess 36 of the runner 35 when the umbrella frame 3 is expanded fully. In addition, the weight 5 facilitates the user pushing the control shaft 2 toward the umbrella frame 3.

Accordingly, the umbrella frame 3 is expanded when the control shaft 2 is movable toward the umbrella frame 3 and is folded when the control shaft 2 is movable outwardly relative to the umbrella frame 3, so that the umbrella frame 3 is expanded and folded easily and conveniently. In addition, the user only needs to operate the control handle 16 to move the control shaft 2 so as to expand or fold the umbrella frame 3 easily and quickly, thereby greatly facilitating the user operating the suspension umbrella.

Although the invention has been explained in relation to its preferred embodiment(s) as mentioned above, it is to be understood that many other possible modifications and variations can be made without departing from the scope of the present invention. It is, therefore, contemplated that the appended claim or claims will cover such modifications and variations that fall within the true scope of the invention.

The invention claimed is:

1. A suspension umbrella, comprising:

an unright support post;

a sliding seat mounted on an upper end of the support post;

a control shaft movably mounted on the sliding seat;

an umbrella frame mounted on a first end of the control shaft to move with the control shaft and including a shank, a plurality of ribs each pivotally mounted on an upper end of the shank, a plurality of spreaders each having a first end pivotally connected with a respective rib and a runner pivotally connected with a second end of each of the spreaders and movable relative to the shank;

a drive cord having a first end secured on the sliding seat and a second end extended through the shank of the umbrella frame and secured to the runner of the umbrella frame to move the runner of the umbrella frame relative to the shank of the umbrella frame and to move the spreaders of the umbrella frame relative to the ribs of the umbrella frame;

a limit ring secured on the control shaft to move with the control shaft and movable to rest on the sliding seat;

a cable having a first end secured on the limit ring to move with the limit ring and a second end extended into the support post;

a weight movably mounted in the support post and attached to the cable to move with the cable wherein the second end of the cable is secured to the weight;

a guide roller rotatably mounted on the sliding seat and rested on the cable to guide movement of the cable.

2. The suspension umbrella in accordance with claim 1, wherein the shank of the umbrella frame has an inside formed with a passage to allow passage of the drive cord.

3. The suspension umbrella in accordance with claim 2, wherein the upper end of the shank of the umbrella frame is formed with an enlarged head pivotally connected with the ribs, and the umbrella frame further includes a guide roller rotatably mounted in the enlarged head of the shank and connected to the passage to guide movement of the drive cord.

4. The suspension umbrella in accordance with claim 3, wherein the umbrella frame further includes a fixing seat secured on the control shaft and located between the sliding seat and the umbrella frame, and a pivot lever having a first end pivotally connected with the fixing seat and a second end pivotally connected with the runner of the umbrella frame.

5. The suspension umbrella in accordance with claim 1, wherein the runner of the umbrella frame has an inside formed with a channel to allow passage of the drive cord.

6. The suspension umbrella in accordance with claim 5, wherein the runner of the umbrella frame has an upper end formed with a positioning recess connected to the channel to receive a lower end of the shank when the runner of the umbrella frame abuts the lower end of the shank.

7. The suspension umbrella in accordance with claim 5, wherein the umbrella frame further includes a fixing plate mounted on a lower end of the runner and secured to the second end of the drive cord, and a bottom cap mounted on the lower end of the runner to cover the fixing plate.

8. The suspension umbrella in accordance with claim 7, wherein the lower end of the runner is formed with a stepped receiving recess connected to the channel to receive the fixing plate.

9. The suspension umbrella in accordance with claim 1, wherein the drive cord is stretched between the sliding seat and the runner of the umbrella frame.

10. The suspension umbrella in accordance with claim 1, further comprising a control handle mounted on a second end of the control shaft to move the control shaft, and an elbow having a first end pivotally connected with the support post and a second end pivotally connected with the control handle.

11. The suspension umbrella in accordance with claim 1, wherein the enlarged head of the shank of the umbrella frame is pivotally mounted on the first end of the control shaft.

* * * * *